United States Patent [19]

White et al.

[11] 4,327,274

[45] Apr. 27, 1982

[54] VENTILATION SYSTEM FOR COMBINATION MICROWAVE OVEN AND EXHAUST VENT

[75] Inventors: James A. White, Louisville; Frank L. Rice, Jeffersontown; Walter E. Lewis, Louisville, all of Ky.

[73] Assignee: General Electric Company, Louisville, Ky.

[21] Appl. No.: 142,943

[22] Filed: Apr. 23, 1980

Related U.S. Application Data

[63] Continuation of Ser. No. 935,436, Aug. 21, 1978, abandoned.

[51] Int. Cl.[3] ..... H05B 6/64; F24C 15/30

[52] U.S. Cl. ..... 219/10.55 R; 219/400; 126/299 D; 126/21 A; 126/198; 98/115 VM; 312/236

[58] Field of Search ..... 219/10.55 R, 10.55 D, 219/10.55 E, 10.55 F, 10.55 B, 10.55 M, 399, 400; 126/299 R, 299 D, 299 E, 21 R, 21 A, 198, 193; 98/115 R, 115 VM, 115 LH, 115 SB; 312/236

[56] References Cited

U.S. PATENT DOCUMENTS

| | | | |
|---|---|---|---|
| 1,492,582 | 5/1924 | Smith | 126/21 A |
| 2,275,772 | 3/1942 | Koch | 126/299 R |
| 3,089,479 | 5/1963 | Perl | 219/400 X |
| 3,130,719 | 4/1964 | Mayer et al. | 126/21 R |
| 3,180,331 | 4/1965 | Jenn et al. | 126/21 A |
| 3,384,067 | 5/1968 | Rawald et al. | 126/299 R X |
| 3,514,577 | 5/1970 | Dills | 126/299 R |
| 3,514,578 | 5/1970 | Dills | 126/299 R |
| 3,576,417 | 4/1971 | Tingley | 219/10.55 E |
| 3,633,561 | 1/1972 | Barnett | 126/21 R |
| 3,654,417 | 4/1972 | Javes et al. | 219/10.55 R |
| 3,783,219 | 1/1974 | Tateda | 219/10.55 D |
| 3,812,838 | 5/1974 | Mutchler | 126/21 A |
| 3,818,171 | 6/1974 | Miller et al. | 219/10.55 R |
| 3,973,551 | 8/1976 | Caselani et al. | 126/21 A |
| 4,011,803 | 3/1977 | Pfaffinger | 98/115 K |
| 4,123,643 | 10/1978 | Burke | 219/10.55 R |
| 4,180,049 | 12/1979 | Carr et al. | 219/10.55 R X |
| 4,184,945 | 1/1980 | Morgan et al. | 219/10.55 R X |

OTHER PUBLICATIONS

A. D. Brochure by Litton Corp., 7-19-76.

A. D. Brochure by Modern Maid Inc., 12-5-66.

*Primary Examiner*—B. A. Reynolds

*Assistant Examiner*—Philip H. Leung

*Attorney, Agent, or Firm*—Radford M. Reams

[57] ABSTRACT

An assembly for combining an appliance, for example a microwave oven, with a range vent hood having an appliance housing and a support structure for mounting the housing to a wall or to the floor of an overhead cabinet above a conventional cooking range is disclosed. The support structure includes a back wall upon which ribs are formed so as to space the rear of the housing from the back to form a channelized air space therebetween. A plate is attached to a lower portion of the back wall and extends forwardly toward and beneath the front of the appliance housing to form a second channelized air space between the plate and bottom of the housing. The two air spaces thus formed, communicate with one another to permit cooking gases and vapors from the range to be drawn upward through openings in the plate, then through the two air spaces and out the assembly on or near a top rear portion thereof. Ventilating means for the microwave oven completely separate and distinct from the first and second channelized air vent spaces is also provided so that the range heed vent feature and the microwave vent feature of the assembly can be used independently from one another or concurrently as desired.

17 Claims, 6 Drawing Figures

VENTILATION SYSTEM FOR COMBINATION MICROWAVE OVEN AND EXHAUST VENT

This is a continuation of application Ser. No. 935,436, filed Aug. 21, 1978, now abandoned.

BACKGROUND OF THE INVENTION

This invention relates generally to an assembly for combining an auxiliary cooking appliance, such as a microwave oven, with a vent hood used in association with a cooking range of the traditional type.

One such assembly known in the prior art is the so-called Hi-Low range manufactured by the General Electric Company which is a unitary structure having a traditional electric range mounted in a lower portion and a microwave oven mounted in an upper portion. A vent hood assembly for the traditional electric range is formed above the microwave oven with an inlet port located above the front of the microwave oven. As a result, gases and vapors generated while cooking on the traditional range rise and are drawn upward across the front face of the microwave oven and into the range vent inlet port. Should the microwave oven be operated while such cooking gases and vapors are rising from the electric range across the front face of the former, a portion of these moisture and grease laden gases and vapors may be drawn into the microwave oven ventilating system, the inlet port to which is typically located in the bottom of the microwave housing. In such an event, the electronic components of the microwave oven can become contaminated with grease, vapors and other gaseous cooking products generated by the electric range below.

In addition, while combination products of the above general type have been known in the art, they have generally been larger than desirable. Specifically, prior art combination oven and exhaust vent structures have projected outwardly from the mounting wall to an extent which substantially obstructs an average user's view of the range or cooking appliance located therebelow. This is more particularly true where the range has its controls located in the rear thereof.

Our invention substantially overcomes these and other prior art difficulties.

SUMMARY OF THE INVENTION

It is an object of our invention to provide a combination cooking appliance and range vent hood which utilizes a portion of the surfaces of the cooking appliance housing to partially define a channelized air space through which gases and vapors generated by a traditional cooking range therebelow can be vented.

It is another object of our invention to provide a combination microwave oven and traditional cooking range vent hood which permits mounting of the assembly above a traditional cooking range so as to provide maximum visibility of the range controls located on the traditional range below the combination.

Briefly, in accordance with the objects of our invention, we provide an assembly for combining an appliance with a range vent hood which includes means for forming a housing for the appliance, means for supporting the housing and means for spacing at least a portion of the housing from the supporting means to provide an air space therebetween. A means for channelizing the air space between an inlet and an outlet end, and a means for venting gases and vapors which enter the inlet end from the outlet end is also provided.

The assembly also provides another air conduit system independent of the one noted above which moves air from outside the assembly through the electronic component compartment and the oven cavity and back outside of the assembly. Each of the circulation systems includes its own power driven fan to move air.

Additional objects, features and advantages of our invention will become apparent to those skilled in the art from the following detailed description and attached drawings upon which, by way of example, only a preferred embodiment of our invention is illustrated.

DESCRIPTION OF THE PREFERRED EMBODIMENT

Figure 1:
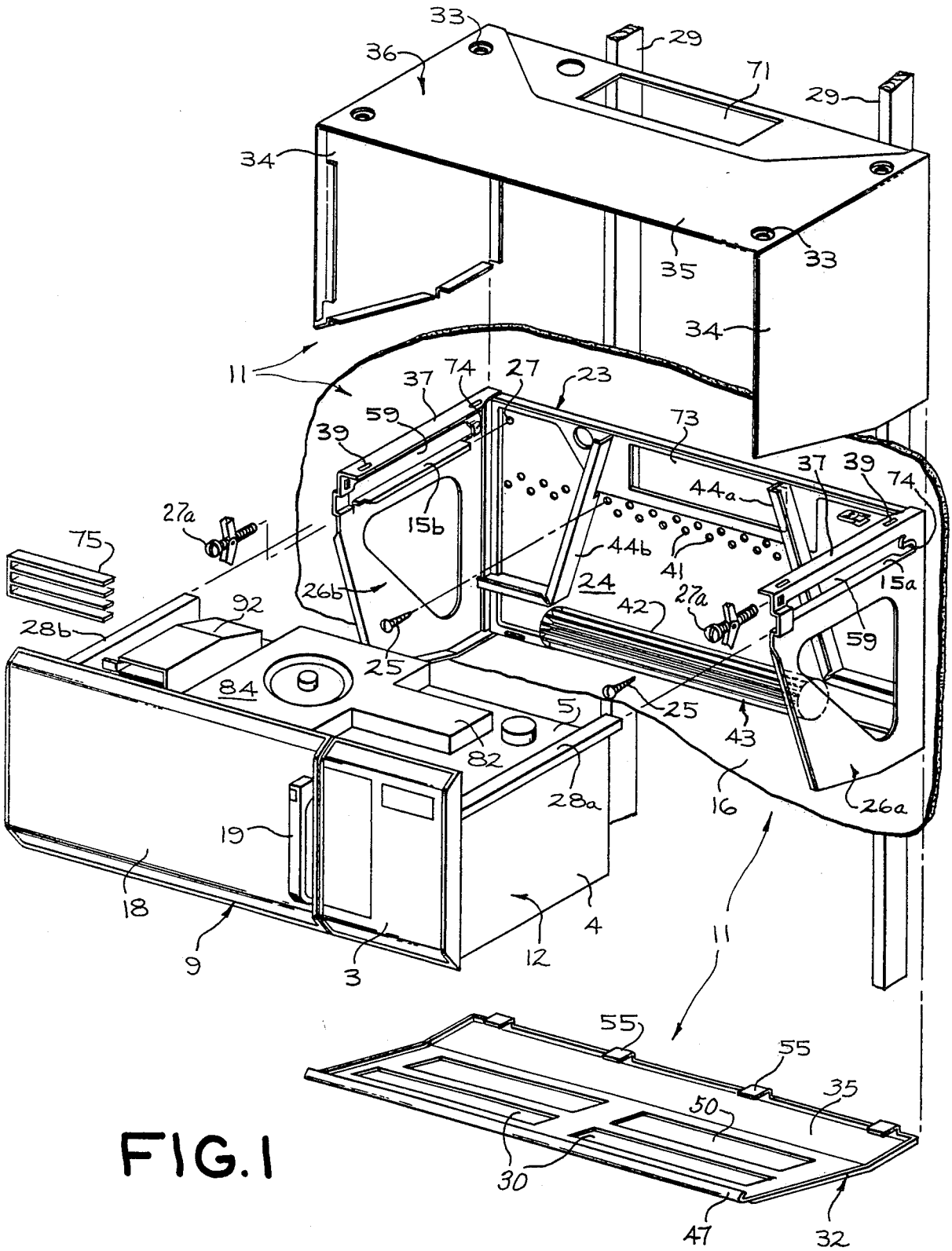
FIG. 1 shows an illustrative exploded perspective view of the oven/vent assembly of the invention, with some air ducts omitted for clarity from the module 9.

Referring to the drawings, the microwave oven appliance of the invention is seen to generally comprise a support assembly 11 including a main support 23, a top cover 36, and a bottom closure 32 which are coupled together to form an enclosure which supports a microwave oven operating module or assembly 9. The overall assembly and the installation method therefor is described in detail in concurrently-filed, commonly assigned application Ser. No. 935,433 filed Aug. 21, 1978 in the joint names of James A. White and Frank L. Rice, entitled COMBINATION MICROWAVE OVEN AND EXHAUST VENT AND INSTALLATION MOUNTING METHOD THEREFOR, which disclosure is hereby incorporated by reference. The description of the various components of the appliance will be given herein only to the extent necesary to understand the air circulation arrangements incorporated therein.

Figure 2:
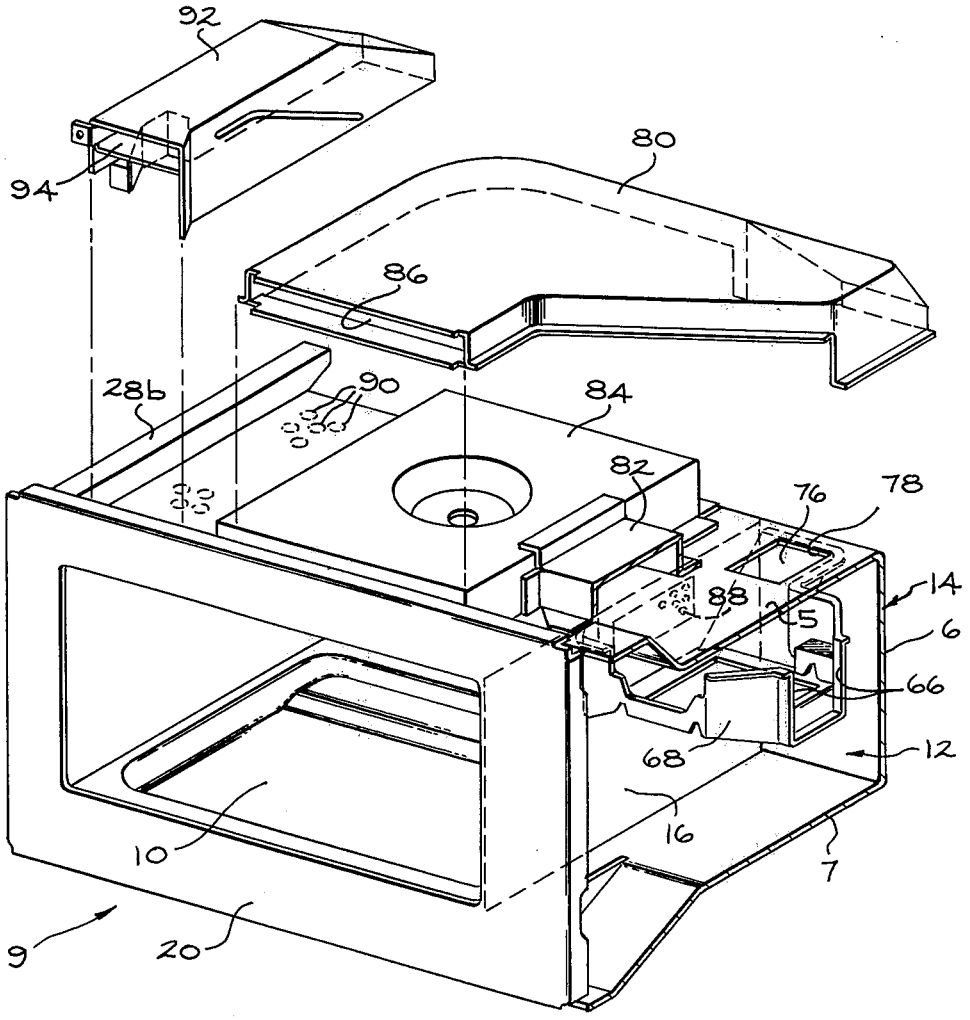
FIG. 2 shows an illustrative exploded perspective view of the oven operating module of the assembly showing the air duct appendages displaced from the main frame and the air flow opening utilized in the air circulation system.

The microwave oven assembly or module 9 includes a cooking chamber 10 and an adjacently disposed oven control compartment 12 which houses an electronics package for operating the oven, both being located within a housing or main frame 14 and separated one from the other by a partition wall 16 of FIG. 2. Access to the cooking chamber 10 is had through a door 18 mounted on a door frame 20, the latter being joined along its top and bottom edges to forward end portions of the upper and lower surfaces of the main frame 14. The door 18 is hingedly supported at the left side thereof and is operable by means of a handle 19. A cover piece 3 closes the front facing opening to the compartment 12.

The main frame 14 of the module 9 is generally composed of sheet metal in accordance with concurrently-filed and commonly assigned application Ser. No. 935,445, filed Aug. 21, 1978, now U.S. Pat. No. 4,282,416 in the name of James A. White, entitled UNITIZED OVEN STRUCTURE FOR A MICROWAVE OVEN, which disclosure is hereby incorporated by reference. That application may be referred to for details of construction for the sheet metal body of the module 9, which forms no part of this invention and the details of which are being omitted for the sake of brevity. Briefly, however, the sheet metal body or frame 14 includes a top wall 5, sidewalls 4, a rear wall 6 and a bottom wall 7. The top wall 5 has a pair of elongated rails 28*a*, b which have a generally inverted L-shaped cross-section formed along the sides of the top wall and extending substantially the entire depth of the module.

The frame 14 has appendages to the top wall 5 including a waveguide 82 and a mode stirrer housing 84. The waveguide conducts microwave energy generated by a magnetron (not shown) located in the compartment 12 into the mode stirrer housing 84 from whence it is directed downwardly into the microwave oven cavity 10 in a manner well known in the art.

The cooking chamber 10 is closed except for the door opening and two air permeable or perforated areas, the first area 88 being in the right sidewall, through the partition 16, and the second area 90 being located in the top wall at the left of the assembly. A combination lamp housing and air guide member 92 covers the perforated area 90 and operates to guide air from the oven chamber to the exterior of the assembly as will be explained hereinafter. An air directing duct 80, FIG. 2, is attached to the top wall of the module 9 over the waveguide 82 and mode stirrer housing 84 which also aids in directing air through the assembly which exits the electronics compartment through an opening 76, FIG. 2, in the top wall thereof. An air duct 68 is also supported in the chamber 12 for funnelling air along its various paths as will be explained hereinafter in greater detail.

The main support member 23 provides essentially the entire support for the arrangement, and for this purpose is constructed of a relatively heavy gauge sheet metal. The main support member 23 includes a back wall 24, adapted to fit substantially flush against a conventional wall board 16, and a pair of appliance supporting integral sidewalls 26*a* and 26*b*. The back wall 24 has an opening to provide a vent path out of the assembly along the back thereof, the opening being either blocked by a suitable covering piece or brought into air communication with a range exhaust flue or conduit for venting to the exterior as explained hereinafter.

The back wall 24 contains on its interior surface a pair of raised walls or ribs 44*a* and 44*b* for enhancing the strength and rigidity thereof. The ribs also perform the function of directing exhaust air through the structure.

Multiple rows of holes 41 extend across the back wall 24 through selected ones of which at least one lag screw 25 or other suitable threaded fasteners can be inserted to securely mount the assembly to the wall board 16 and to at least one wall support member or stud 29. A pair of holes 27 located in the upper right and left hand corners of the back wall 24 permits the main support member 23 to be further secured to the wall board 16 with suitable fasteners such as a pair of toggle bolts 27*a*.

In order to provide support for the oven module 9 when inserted into the support assembly, the sidewalls 26*a* and 26*b* have formed thereon a pair of rails 15*a* and 15*b*. The rails are formed by punching out and bending inwardly an elongated piece of sheet metal, the openings 59 resulting from this process. The rails 15*a* and 15*b* extend front to rear across substantially the entire depth of the sidewalls 26*a* and 26*b*.

The sidewalls 26*a* and 26*b* on the support member 23 are provided with inwardly directed flanges 37 on the top edges thereof, the latter flanges having a plurality of slots 39 formed therein adjacent the four corners of the member 23. These openings are used in combination with similar holes 33 in the cover 36 to couple the support assembly to an overhanging cabinet, if needed.

The cover 36 is a generally inverted U-shaped member formed from a relatively light gauge of sheet metal comprising sidewalls or arms 34 which extend downwardly at right angles away from a top wall or central portion 35. The wall 35, as alluded to in the previous paragraph, is provided with a set of openings 33 which are aligned with the set of slots 39 in the member 23 so that suitable fasteners, such as screws, may be inserted therethrough to attach the assembly including the cover 36 and support member 23, to an overhead cabinet. The cover is positioned over the member 23 so that the arms 34 thereof straddle the sidewalls 26*a* and 26*b* on the outside thereof. Aligned holes (not shown) are provided in the cover and member 23 through which screws may be inserted to hold these pieces together. The exterior or outside faces of the cover 36 are finished in a conventional manner to provide an acceptable pleasing outward appearance for the arrangement.

The main support member 23 also has suitable formations for supporting a power driven, exhaust air moving assembly 43 (FIG. 1) including a fan or blower wheel 42 located centrally of the member 23 and in air communication with the closure plate 32. The assembly 43 is attachable to the support member 23 prior to insertion of the module 9.

A panel or closure plate 32 serves to close off the bottom wall of the support assembly. The plate 32 includes tabs 55 along the rear edge thereof which interfit with slots 57 along the lower edge of the back wall 24, FIG. 5. The front edge of the cover plate 52 has an inwardly turned lip 47 which resiliently cooperates with a mating formation on the lower front edge of the module 9 to hold the front of the plate 32 in place. The plate 32 is provided with appropriate rectangular vent openings 30 having air intake filters 31 positioned therein. The base plate 32 may also be provided with a translucent panel 49 overlying additional openings 50 and above which light-emitting means may be positioned to illuminate the range heating surface located below the oven.

The oven is assembled by joining the cover 36 and plate 32 to the support member 23 which results in a support assembly or enclosure closed on the top, rear, sides and bottom, but open at the front. The module 9 is then slid rearwardly into the enclosure along rails 15*a* and 15*b* until the rear wall 6 of the module 9 abuts the ribs 44*a* and 44*b*.

It should be noted that when the module 9 is positioned within the support assembly thus formed, a space is created between the top wall 35 of the cover 36 and the top wall 5 of the oven module 9. It is in this space that the lamp mounting and air directing duct 92 and duct 80 are positioned. This space is closed at the front of the assembly by an air permeable grille 75.

Having explained in general the basic elements of the microwave oven and exhaust vent assembly of this invention, a detailed description will now be given of the novel air circulating arrangements incorporated thereinto which are the specific subject of this application.

Figure 3:
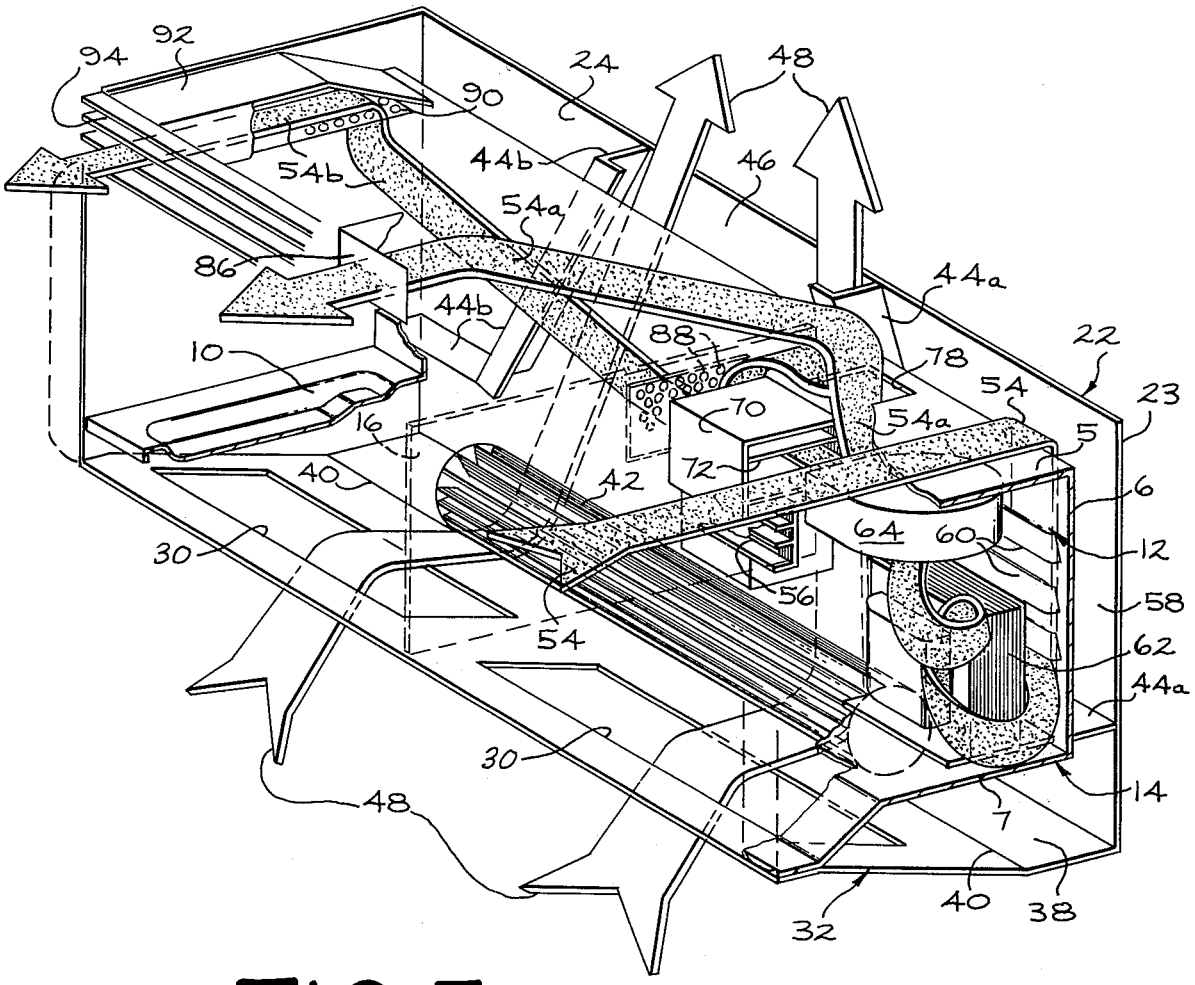
FIG. 3 is an illustrative perspective view of the module of FIG. 2 mounted in a support assembly highlighting the air circulation paths through the mounted appliance.
Figure 4:
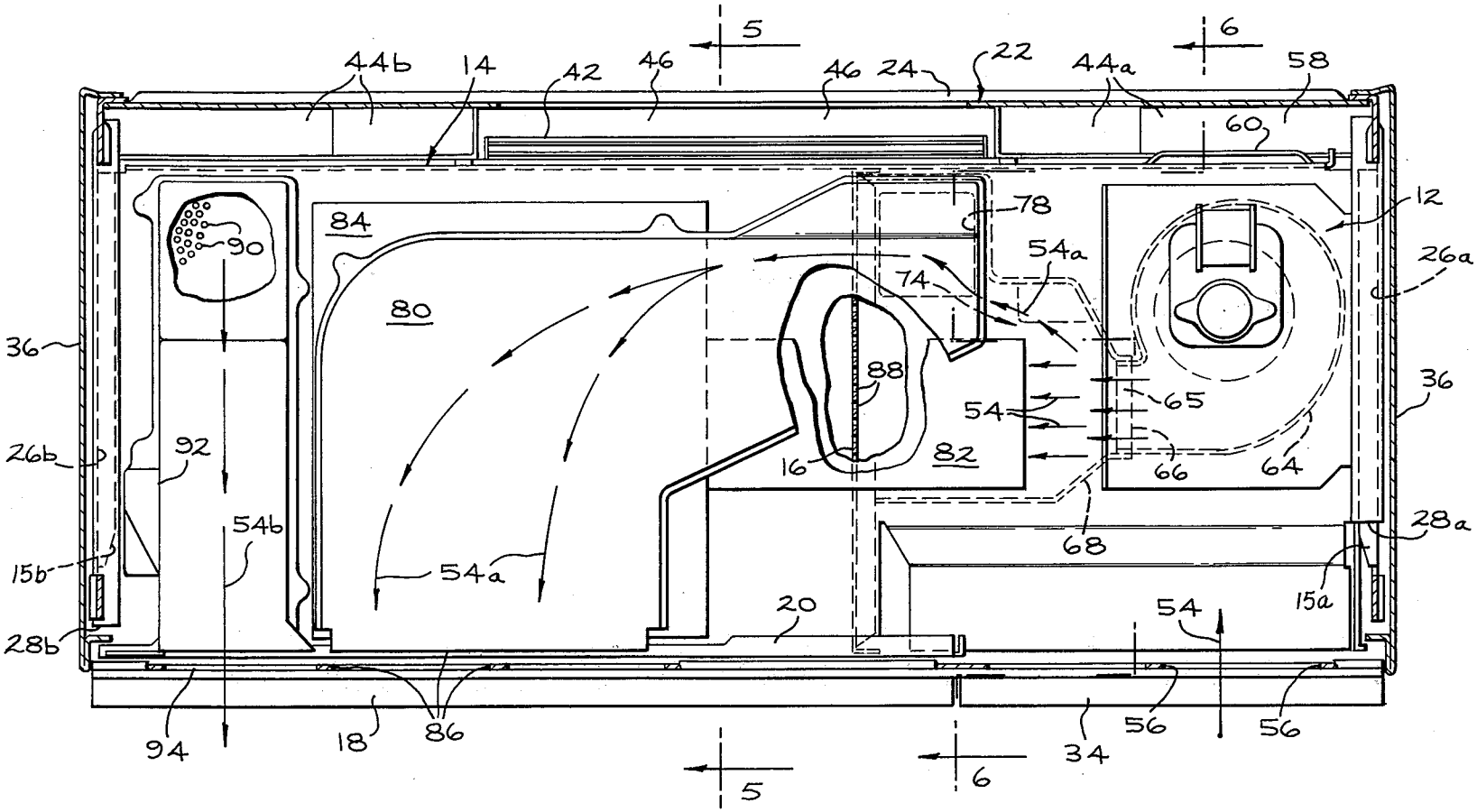
FIG. 4 shows a top plan view of the assembly of FIG. 3.
Figure 5:
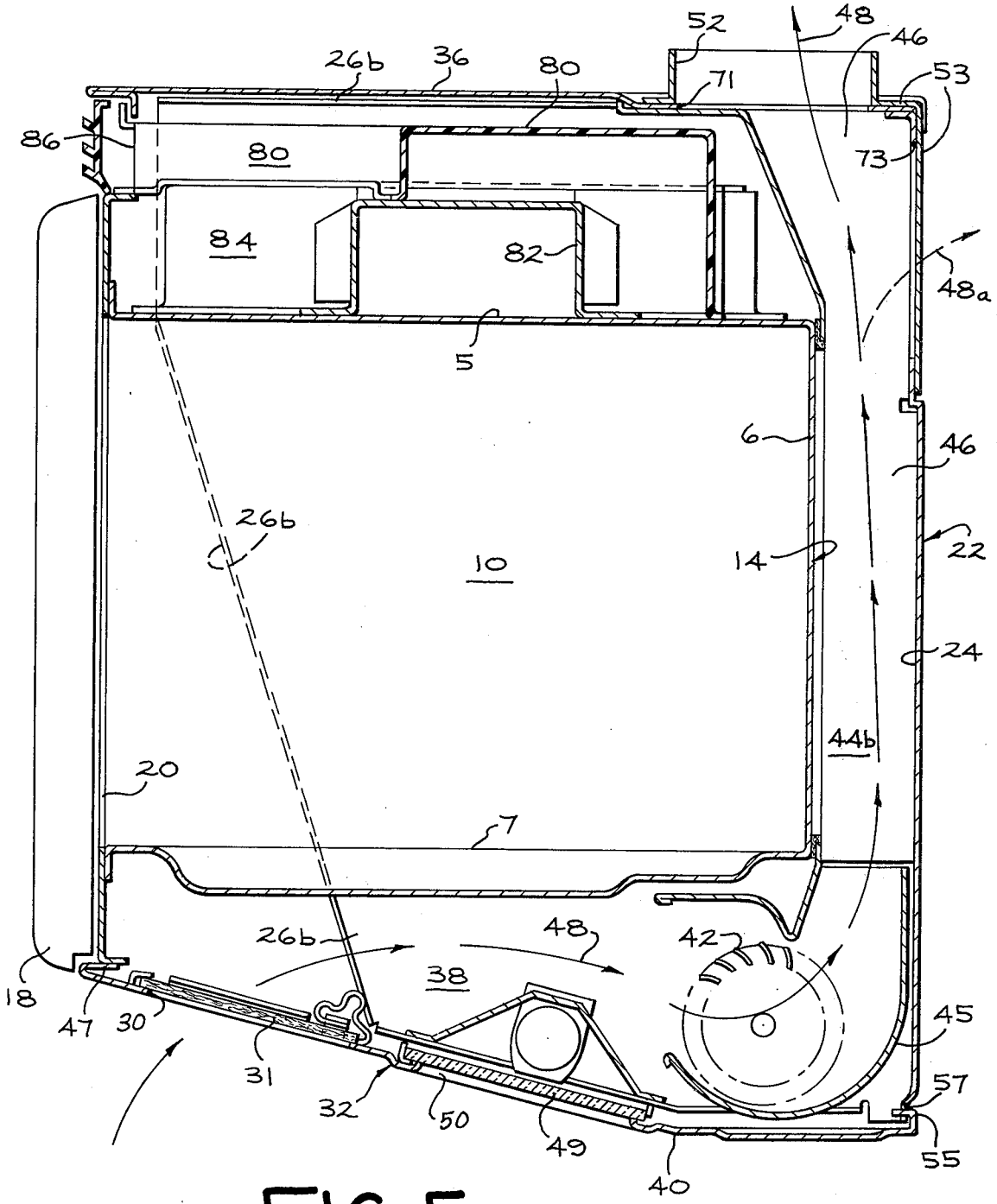
FIG. 5 shows a cross-sectional elevational view of the assembly of FIG. 3 as generally viewed along lines 5—5 of FIG. 4.
Figure 6:
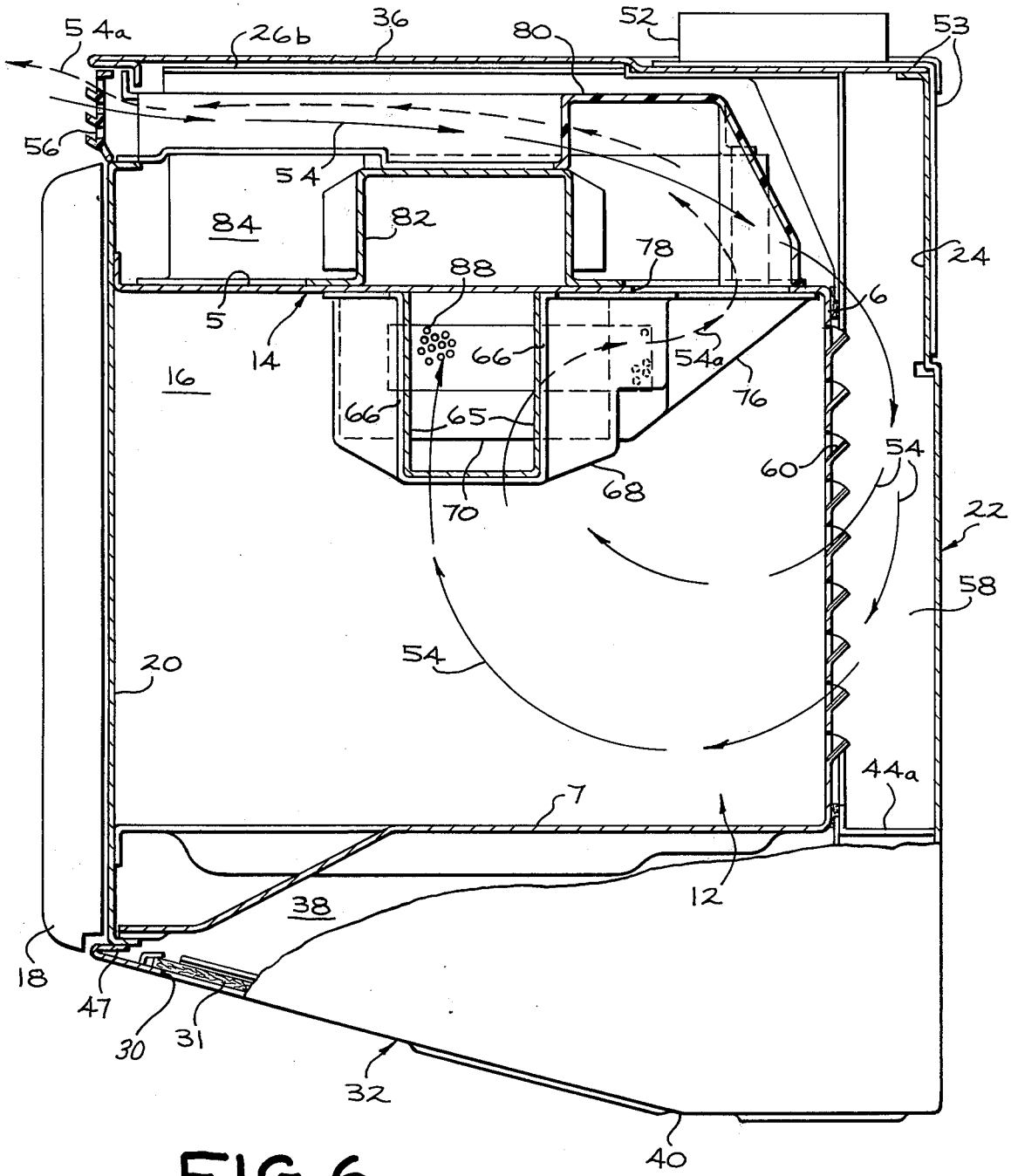
FIG. 6 shows a fragmented side elevational view of the assembly as generally viewed along lines 6—6 of FIG. 4, with selected parts included to illustrate certain features of the air ventilating system.

The back wall 24 of the main support member 23 extends below the bottom wall 7 of the microwave oven module 9 such that a substantial air plenum or space 38 is formed between the plate 32 and the bottom surface of the oven main frame 14. This gap or plenum chamber 38 extends horizontally along the longitudinal dimension of the assembly between the sidewalls 26*a, b*. The sidewalls 34 of the cover 36 overlying the sidewalls 26*a, b* may also be employed or cooperate to enclose the ends of the gap 38. It will be noted that the plate 32 extends horizontally forward from its connection with the back wall 24 to a crease or bend line 40 to provide an enlarged space along a rear portion thereof in which is located a cylindrically-shaped tangential fan or blower wheel 42. The blower wheel 42 has its longitudinal axis extending parallel to the plane occupied by the back wall 24 and bottom wall 7 of the module 12. The blower wheel 42 is, in turn, carried within an air channeling piece 45, FIG. 5, of generally J-shaped cross-section connected to and supported by the back wall 24. Such a tangential fan operates to draw air into the bladed rotating cylinder thereof in one direction and to direct the same air away from the cylinder in a direction approximately 90 degrees displaced from the direction of flow of the entering air. In addition, by positioning the bulky impeller of the blower in the enlarged rear portion of the plenum 38, the plate 32 is permitted to slope upwardly toward the front and intersect the module 9 near the lower edge of the access door 20. This latter feature permits greater visibility of the space underneath the assembly when it is mounted in an elevated position. Thus, by locating the wheel 42 in the preferred lower rear corner position as shown in FIGS. 3–5, an intake air stream 48 is created which takes a right angle turn in direction in passage through the blower wheel 42. A greater efficiency thus results from locating the blower wheel 42 at the 90 degree bend in the path of the air stream 48 than would result if the blower wheel 42 were located elsewhere.

The pair of raised ribs or spacers 44*a* and 44*b* carried by the back wall 24 separate the back wall 24 from the rear surface 6 of the oven module 9. A vertically extending air duct or conduit 46 is thus formed, the sides of which are defined by the opposing diagonally extending ribs 44*a, b*, and the front and back of which are defined by the rear wall 6 of the oven module 9 and the back wall 24, respectively. The vertically extending air conduit 46 communicates along a lower portion thereof with the plenum 38 in the region at the lower rear of the assembly in which the blower wheel 42 is disposed. Accordingly, the adjoining plenum 38 and conduit 46 jointly from a continuous air conducting conduit along which exhaust fumes, gases and vapors, as generally designated in FIGS. 3 and 5 by means of arrows 48, can pass through the assembly. Such gases 48 enter through filters 31, being drawn into and through the plenum 38 with the aid of the rotating blower wheel 42 which redirects such gases upwardly through the conduit 46 and opening 71 in the cover 36 and out the top of the assembly through a vent port 52. By reason of the air flow path 48 formed in the assembly of our invention, the assembly is adapted for use not only as a microwave oven but also as a vent hood for a conventional cooking range. Accordingly, the assembly may be mounted to a wall or to the floor of an elevated wall cabinet such that the plate 32 is spaced a suitable distance above the cooking elements on the surface of a conventional kitchen range. In this manner, the space traditionally occupied by a conventional range vent hood can be more efficiently utilized. The oven assembly of our invention thus may be substituted in place of the usual vent hood such that the vent hood function is retained. At the same time, the oven assembly is conveniently located above and near the conventional cooking range without the loss of valuable cabinet or counter space. The vent port 52 can, of course, be connected in any suitable manner to a conventional wall mounted vent or flue structure as found in a large number of residential kitchens.

The vent port 52 is preferably formed on L-shaped plate 53 which removably overlies an upper rear corner portion of the cover 36. The opening 71 underlies and registers with the opening in the vent port 52. The vent port 52 may then be connected to an overhead flue in the usual manner to permit the exhaust of gas fumes from the surface of a traditional cooking range upwardly into and along the spaces 38 and 46, thence through the port 52 and out the top of the assembly as shown in FIG. 5. In the alternative, the plate 53 may be installed over the top rear corner portion of the cover 36 so that the port 52 projects rearwardly behind an upper portion of the back wall 24 and the opening therein aligns with the opening 73 in the rear wall 24, FIG. 5. The latter arrangement will permit the exhaust gases 48 flowing in the space 46 to exit the assembly through the opening 73 in the upper portion of the back wall 24, as indicated by an arrow 48*a* in FIG. 5.

Thus having explained the nature and use of the assembly of our invention as a vent hood for a conventional cooking range located beneath the plate 32, reference is now made to the air ventilating features of the assembly relating to the microwave oven chamber 10 and oven electrical control compartment 12 with particular reference to FIGS. 3–6. A stream 54 of ventilating air for the microwave oven operating system of the assembly enters the latter through a grilled air inlet port 56, FIG. 3, located at the top righthand side of the front of the assembly over the control compartment front panel 3. Thereafter, the stream 54 is drawn horizontally and rearwardly across the upper right surface of the oven main frame 14 directly above the compartment 12. The top surface 35 of the cover 36 and the upper surface of the main frame 14 jointly define an enclosed channel for the stream 54 in this region of the assembly. The air stream 54 is drawn over the upper rear corner of the oven main frame 14 and thence downwardly along an air conduit 58 provided between the back of the frame 14 and the back wall 24 of the support assembly 22 to the right of the diagonally extending portion of the rib 44*a* as viewed in FIG. 3. As the stream 54 flows downwardly through the conduit 58, it is drawn through a series of louvers 60 formed in the back of the oven main frame 14 and into the interior of the control compartment 12. Upon entering the control compartment 12, the stream 54, which has previously been relatively laminar in character, flows through and around various electronic and power supply components, such as a transformer 62, to become disrupted into a turbulent air flow pattern as indicated in FIG. 3 by a looping air flow pattern. This turbulent flow serves to cool the electronic components in the compartment 12 generally.

After cooling various electronic and power supply components, the stream 54 is drawn into the low pressure input side at the base of an air moving means or blower 64 wherein it is compressed into a relatively high pressure volume of air and emitted from a high pressure output side 65 directly into an opening 66 of a plastic air directing duct 68 (see FIGS. 2 and 4). The duct 68 contains a housing 70 in which a conventional microwave signal generating magnetron, not shown, is disposed. Attached to the magnetron is a series of vertically stacked cooling fins or heat exchanger plates 72, FIG. 3, between and across which the high pressure air stream 54 emitted from the blower 64 is directed.

Since the blower 64 may generate a considerably greater volume of high pressure air than can be passed through the relatively closely spaced plates 72, an air stream 54*a* is vented which bypasses the plates 72 on one side thereof. This by-pass air stream 54*a* flows upwardly along a ramp 76 formed in the duct 68 and through a rectangular opening 78 in the upper surface of the oven main frame 14. Thereafter, the by-pass air stream 54*a* flows through an exhaust duct 80, FIG. 2, attached to the top of the microwave waveguide 82 and a mode stirrer housing 84 located on the upper surface 5 of the module 9 and is exhausted out of the assembly through an air outlet port 86 and grille 75 above the oven door 18.

Now as to the main air stream 54 which does pass between and through the heat exchanger plates 72, the same is directed against a perforated portion 88 of the partition 16. Here again, the volume of air in the stream 54 which passes through the plates 72 may be greater than that required to ventilate the oven chamber 10. In such a case, the gauge and density of the perforations in the wall portion 88 should be selected to allow only the desired volume of ventilating air to flow through the partition 16 into the cooking chamber 10. Any excess volume of output air from the plates 72 not required to ventilate the chamber 10 will strike the portion 88 of partition 16 within the confines of the plastic chamber 68 and will be diverted sidewardly up the ramp 76 to join the by-pass air stream 54*a* to ultimately exit the assembly through the port 86. The volume of the air stream 54*b* which passes through the perforated wall portion 88 thereafter circulates through the chamber 10 to combine with cooking gases, after which the air stream 54*b* and various cooking gases exit through a perforated section 90 formed in the upper surface of the main frame 14 and flows forwardly along a guide member 92. Ultimately, the air stream 54*b* exits the front of the assembly through a grilled exhaust port 94 located above the door 18 on the opposite side of the assembly from which the air stream 54 originally entered.

It will be noted that the microwave ventilating air stream 54 is completely separate and distinct from the range vent air stream 48 from entry to exit of the assembly. Thus, the assembly is readily adapted for use of the microwave oven air flow system or the range vent system separately and independently of one another, as well as concurrently. This is a particularly advantageous feature of our invention where the microwave air stream 54 is not sufficiently strong to operate a flue damper mechanism of the type found in the kitchens of some homes.

Although the subject invention has been described with respect to specific details of certain preferred embodiments thereof, it is not intended that such details limit the scope of our invention otherwise than as set forth in the following claims.

We claim:

1. An assembly combining a microwave oven appliance with an exhaust vent hood, said assembly adapted for positioning in an elevated position above a cooking surface, comprising:

means forming a housing for said appliance having a top, a bottom and a rear surface, means forming a support structure for said housing having a top and a back wall, said support structure adapted for mounting in said elevated position independently of said housing, said housing and support structure having cooperation means for slidably moving said housing into and out of said structure with said top surface of said housing positioned below said top wall of said structure, elongated rib means spacing said rear surface from said back wall; said rear surface, back wall and rib means defining a first channelized air space therebetween when said housing is within said structure, plate means spaced below said bottom surface for providing a second air space therebetween, said first and second air spaces communicating with one another, said plate means defining an opening through which air can flow from a level below said plate means into said second air space, means enclosing the sides of said second air space for channelizing the same, means for forcibly moving air from below said plate into said second air space, and through said second air space into and through said first air space, an air entry formed in said rear surface of said housing, means for drawing oven cooling air into said housing through said entry, and means, including said housing, said support structure and said rib means, forming a third channelized air space separate from said first and second air spaces and communicating with said air entry in said rear surface for providing oven cooling air to the interior of said oven separate from air flowing through said first and second air spaces.

2. The assembly of claim 1 wherein said rib means comprises a pair of raised ribs formed on said back wall.

3. The assembly of claim 1 wherein said plate means projects horizontally forward from said back wall a selected distance to a bend line and thereafter extends diagonally upward to engage a bottom portion of said housing.

4. The assembly of claim 1 wherein said side enclosing means comprises a pair of sidewalls formed on opposite sides of said back wall and extending forwardly along the sides of said housing and plate means.

5. The assembly of claim 1 wherein said means for forcibly moving air comprises blower means disposed intermediate said plate and said housing.

6. The assembly of claim 2 wherein said ribs extend from opposite sides of said back wall horizontally toward one another to wall positions a first selected distance apart and thence extend diagonally upward along said back wall toward one another to a level of termination at points a second selected distance apart.

7. The assembly of claim 2 wherein said means for forcibly moving air comprises a tangential blower having an elongated cylindrically shaped bladed fan disposed below said ribs between said plate means and housing.

8. The assembly of claim 1 further comprising vent port means removably disposed over a portion of said top wall and back wall for venting said gases and vapors from said first air space.

9. The assembly of claim 6 wherein said means for forcibly moving air comprises blower means disposed between said plate means and housing below and between said horizontally extending portions of said ribs for directing air upward into said first air space between said diagonally extending portions of said ribs.

10. A combination microwave oven cooking appliance and exhaust vent, comprising:

a support assembly for installation in an elevated position above a domestic surface cooking appliance, said support assembly including a top wall and a rear wall;

a unitary microwave oven cooking appliance operating module having a top and a rear surface;

said support assembly and said module having cooperating means for removably mounting said module in said support assembly with said top surface of said module space below said top wall of said support assembly and said rear surface of said module spaced forward of said rear wall of said support structure;

elongated rib means bridging the space between said rear surface and said rear wall for forming therewith a first air passage extending generally vertically between said rear wall and said rear surface;

first blower means mounted in said support assembly for drawing air from the vicinity of the surface cooking appliance below said support assembly and venting it through said first air passage;

said module including an inlet for admitting cooling air into said module, second blower means in said module for drawing cooling air into said module through said inlet; said support assembly, module and rib means forming a second air passage isolated from said first air passage and connecting said inlet to the exterior of said support assembly through the space between said top surface and said top wall so that cooling air for said microwave oven is separate from air vented from the vicinity of the surface cooking appliance.

11. The combination set forth in claim 10 wherein said first passage includes an outlet end adapted to communicate with an exhaust flue for removing air from the vicinity of the surface cooling appliance.

12. The combination set forth in claim 10 wherein said module has a front structure and said support assembly includes a bottom wall sloping downwardly and rearwardly from the lower portion of said front structure to said rear wall of said support assembly and defining an air intake plenum below said module and communicating with said first air passage; said plenum having a relatively large section at the rear thereof; said first blower means is positioned in said relatively large plenum section.

13. The combination as set forth in claim 12 wherein the cross-sectional area of said first air passage has a relatively long dimension extending horizontally from side to side of said support assembly rear surface and said first blower means includes an elongated generally cylindrical blower wheel mounted in alignment with said first air passage and with its elongated axis parallel to the relatively long cross-sectional, dimension of said first air passage.

14. The combination as set forth in claim 10 wherein said rib means comprises at least one elongated projection extending forward from said rear wall of said support assembly and engaging said rear surface of said module when said module is mounted in said support assembly.

15. The combination as set forth in claim 14 wherein at least a portion of said second air passage is formed between said rear wall and said rear surface and said at least one elongated projection separates said portion of said second air passage from said first air passage.

16. The combination as set forth in claim 10 wherein said module further includes an outlet for exiting cooling air from said module and further including conduit means communicating with said outlet for conveying the cooling air from said microwave oven and exhaust vent assembly separate from air flow through said first air passage.

17. The combination as set forth in claim 16 wherein said conduit means includes an exhaust port positioned between said top wall and said top surface.

* * * * *

UNITED STATES PATENT AND TRADEMARK OFFICE

CERTIFICATE OF CORRECTION

PATENT NO. 4,327,274

DATED April 27, 1982

INVENTOR(S) James A. White et al

It is certified that error appears in the above—identified patent and that said Letters Patent is hereby corrected as shown below:

In the Claims:

Claim 10, line 12, after "module" delete "space" and insert --spaced--.

Claim 16, line 5, before "microwave" insert --combination--; same line, after "oven" insert --cooking appliance--; line 6, after "vent" delete "assembly".

Signed and Sealed this

*Seventeenth* Day of *August 1982*

[SEAL]

*Attest:*

GERALD J. MOSSINGHOFF

*Attesting Officer*

*Commissioner of Patents and Trademarks*